US010529523B2

(12) United States Patent
Ehrhardt et al.

(10) Patent No.: US 10,529,523 B2
(45) Date of Patent: Jan. 7, 2020

(54) SHORT-CIRCUITING DEVICE FOR USE IN LOW-VOLTAGE AND MEDIUM-VOLTAGE SYSTEMS FOR PROTECTING PARTS AND PERSONNEL

(71) Applicant: DEHN + SÖHNE GMBH + CO. KG, Neumarkt/Opf. (DE)

(72) Inventors: Arnd Ehrhardt, Neumarkt/Opf. (DE); Michael Fromm, Kastl (DE); Stefan Dietweger, Nürnberg (DE)

(73) Assignee: DEHN + SÖHNE GMBH + CO. KG, Neumarkt/Opf. (DE)

( * ) Notice: Subject to any disclaimer, the term of this patent is extended or adjusted under 35 U.S.C. 154(b) by 0 days.

(21) Appl. No.: 16/313,042

(22) PCT Filed: Jun. 7, 2017

(86) PCT No.: PCT/EP2017/063765

§ 371 (c)(1),
(2) Date: Dec. 23, 2018

(87) PCT Pub. No.: WO2018/001686

PCT Pub. Date: Jan. 4, 2018

(65) Prior Publication Data

US 2019/0252145 A1 Aug. 15, 2019

(30) Foreign Application Priority Data

Jun. 30, 2016 (DE) ..... 10 2016 008 066
Aug. 17, 2016 (DE) ..... 10 2016 115 222

(51) Int. Cl.
*H01H 79/00* (2006.01)
*H01H 71/40* (2006.01)
*H01H 39/00* (2006.01)

(52) U.S. Cl.
CPC ..... *H01H 79/00* (2013.01); *H01H 71/40* (2013.01); *H01H 39/004* (2013.01); *H01H 2039/008* (2013.01); *H01H 2201/002* (2013.01)

(58) Field of Classification Search
CPC ..... H01H 39/004; H01H 2039/008; H01H 71/40; H01H 79/00; H01H 2201/002
See application file for complete search history.

(56) References Cited

U.S. PATENT DOCUMENTS 4,241,248 A * 12/1980 Bernatt ..... H01H 33/14 218/2
4,527,025 A * 7/1985 Patrichi ..... H01H 39/004 102/263

(Continued)

FOREIGN PATENT DOCUMENTS

| | | | |
|---|---|---|---|
| DE | 19746566 | A1 | 4/1999 |
| DE | 102005048003 | B4 | 4/2008 |
| DE | 202012001729 | U1 | 4/2012 |
| DE | 102014016274 | A1 | 3/2016 |
| FR | 2953324 | A1 | 6/2011 |
| WO | WO9619816 | A1 | 6/1996 |
| WO | WO2007014816 | A1 | 2/2007 |

OTHER PUBLICATIONS

The Notification Concerning Transmittal of International Preliminary Report on Patentability (Chapter I of the Patent Cooperation Treaty), in English, dated Jan. 10, 2019, which was issued by the International Bureau of WIPO in Applicant's corresponding international PCT application having Serial No. PCT/EP2017/063765, filed on Jun. 7, 2017.

(Continued)

*Primary Examiner* — Jacob R Crum
(74) *Attorney, Agent, or Firm* — Bodner & O'Rourke, LLP; Gerald T. Bodner; Christian P. Bodner

(57) ABSTRACT

The invention relates to a short-circuiting device for use in low-voltage and medium-voltage systems for protecting (Continued)

Figure 1:
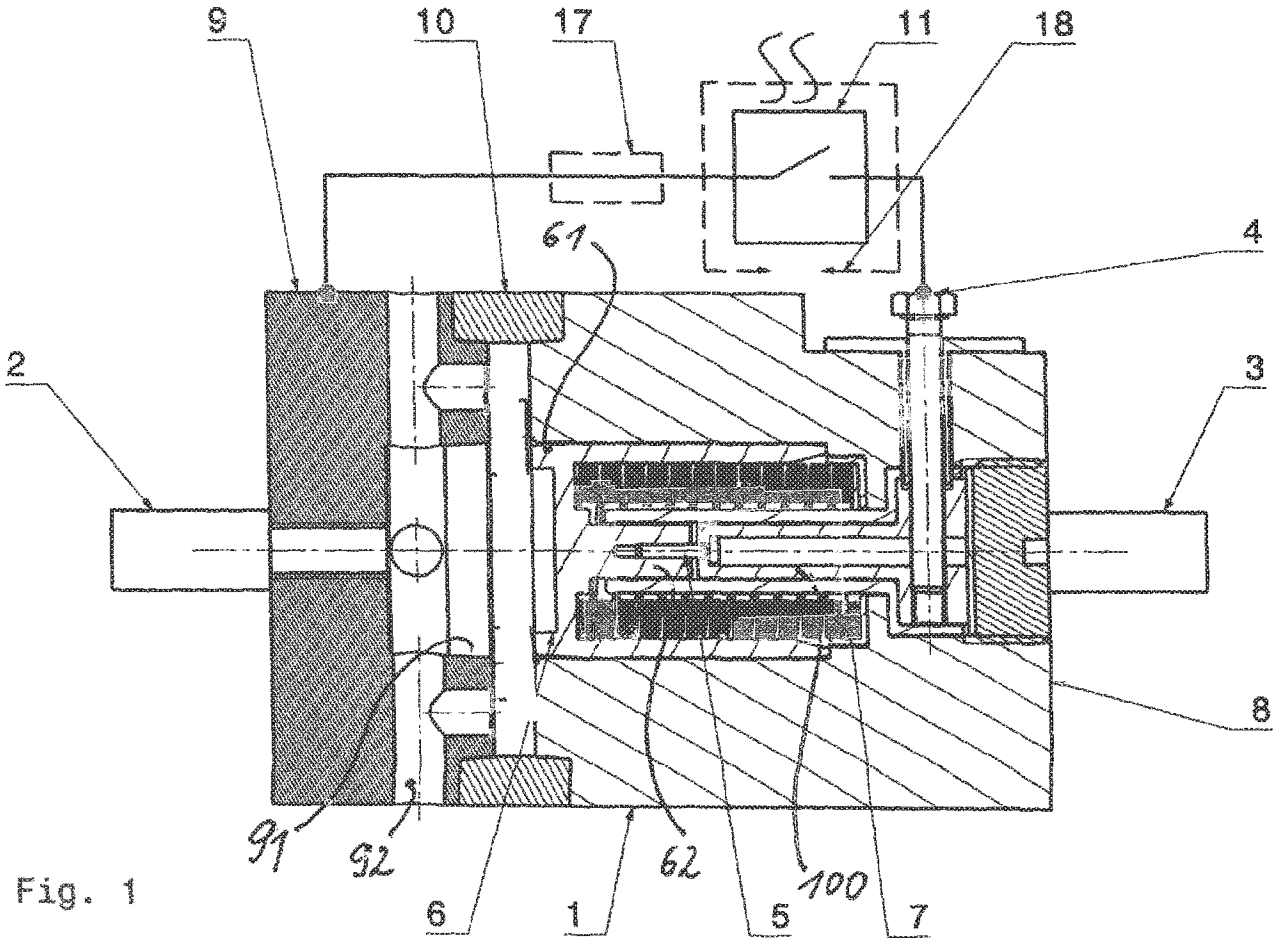

parts and personnel, comprising a switching element which can be operated by the tripping signal of a fault detection device, two mutually opposite contact electrodes having power supply means, wherein contact can be made with said contact electrodes at an electrical circuit having connections at different potentials, furthermore, in at least one of the contact electrodes, a moving contact part which is under mechanical prestress and executes a movement to the further contact electrode in a manner assisted by spring force in the event of a short circuit, a sacrificial element as spacer between the contact electrodes and also having an electrical connection between the sacrificial element and the switching element on the one hand and one of the contact electrodes on the other hand, in order to cause current flow-induced thermal deformation or destruction of the sacrificial element in a targeted manner. According to the invention, the moving contact part is in the form of a hollow cylinder which is closed on one side and a spring for generating prestress is used in the hollow cylinder. The hollow cylinder is guided in a movable manner in a complementary cutout in the first contact electrode so as to form a sliding contact. In the region of the base of the closed hollow cylinder, the cylinder wall of said hollow cylinder is configured to turn into a cone on its outer circumferential side. Furthermore, starting from the base, a first pin-like extension which is situated opposite a second pin-like projection which is insulated from the contact electrodes is arranged in the interior of the hollow cylinder, wherein the sacrificial element, in the form of a bolt or screw, is arranged between the first and the second pin-like projection. A cutout which is matched to the external cone of the moving contact and has an internal cone is provided in the second contact electrode, wherein the external cone and internal cone form a bounce-free short-circuit contact region with a force-fitting and interlocking connection on account of the plastic deformation which occurs.

12 Claims, 6 Drawing Sheets

(56) References Cited

U.S. PATENT DOCUMENTS

| | | | | |
|---|---|---|---|---|
| 9,058,940 | B2 | 6/2015 | Borg | |
| 2009/0141416 | A1* | 6/2009 | Dommaschk | H01H 39/004 361/78 |
| 2010/0051437 | A1* | 3/2010 | Kruska | H01T 1/14 200/502 |
| 2015/0248979 | A1* | 9/2015 | Parks | H01H 39/004 200/61.08 |

OTHER PUBLICATIONS

The English translation of the International Preliminary Report on Patentability (Chapter I of the Patent Cooperation Treaty), dated Jan. 1, 2019, which was issued by the International Bureau of WIPO in Applicant's corresponding international PCT application having Serial No. PCT/EP2017/063765, filed on Jun. 7, 2017.

The Written Opinion of the International Searching Authority, in English, dated Oct. 11, 2017, which was issued by the International Bureau of WIPO in Applicant's corresponding international PCT application having Serial No. PCT/EP2017/063765, filed on Jun. 7, 2017.

The International Search Report, in English, dated Oct. 11, 2017, which was issued by the International Bureau of WIPO in Applicant's corresponding international PCT application having Serial No. PCT/EP2017/063765, filed on Jun. 7, 2017.

* cited by examiner

SHORT-CIRCUITING DEVICE FOR USE IN LOW-VOLTAGE AND MEDIUM-VOLTAGE SYSTEMS FOR PROTECTING PARTS AND PERSONNEL

The invention relates to a short-circuiting device for use in low-voltage and medium-voltage systems for protecting parts and personnel, comprising a switching element which can be operated by the tripping signal of a fault detection device, two mutually opposite contact electrodes having power supply means, wherein contact can be made with said contact electrodes at an electrical circuit having connections at different potentials, furthermore, in at least one of the contact electrodes, a moving contact part which is under mechanical prestress and executes a movement to the further contact electrode in a manner assisted by spring force in the event of a short-circuit, a sacrificial element as spacer between the contact electrodes and also having an electrical connection between the sacrificial element and the switching element on the one hand and one of the contact electrodes on the other hand, in order to cause current flow-induced thermal deformation or destruction of the sacrificial element in a targeted manner, according to the preamble of claim 1.

From DE 10 2005 048 003 B4, a short-circuiting device of the generic kind is already known. According to the teaching there, the sacrificial element is a thin-walled hollow cylinder having a ratio between the diameter and wall thickness of the hollow cylinder of greater than 10:1, wherein the sacrificial element is made of a high melting point metallic material. The related short-circuiter is supposed to have a minimum commuting time at a simultaneously high mechanical strength for deploying high spring force with the goal of reducing the movement time and for the purpose of quickly responding.

In a variant of the prior art teaching, an insulating body and an auxiliary electrode are present in the fixed contact electrode, wherein the auxiliary electrode is in communication with the sacrificial element. The mutually opposite sides of the contact electrodes or the opposite surfaces may have a complementary conical shape with a resulting centering effect when contact is made in the event of a short-circuit.

By defined structures or wall thickness fluctuations in the hollow cylinder, current paths may develop with the effect of an uneven heating when current is applied and a deformation with an associated loss of the mechanical strength. In this case, the conductive connection between the contact electrodes is still preserved, but the mechanical resistance of the hollow cylinder decreases so that under the effect of the spring force, the short-circuiter may be transferred quickly into the desired closing state.

Between the contact electrodes, an exhaust duct or a vent bore may be effective in the closed state in order to prevent forces resulting from a pressure increase in the event of a short-circuit, in particular when an electric arc occurs, from developing which counteract the movement of the contact electrodes towards each other in a closing time delaying manner. The device for generating the prestress force may be realized according to the prior art as a pressure spring, cup spring or similar spring arrangement.

In a second embodiment according to DE 10 2005 048 003 B4, the sacrificial element may be a wire or a rod of a conductive material having a low melting integral, wherein the sacrificial element, upon tensioning, is under mechanical prestress.

In general, the task for short-circuiters for protection of systems is to realize a metallic short-circuit very quickly so that very high currents can be conducted in a short time.

When metallic contacts close quickly, it is difficult to avoid contact bouncing. As a consequence of the bouncing but also with regard to the level of the flowing current, electric arcs might develop between the contacts which seriously damage the upper surface of the contacts, whereby a safe conducting of the current over an extended period is jeopardized. In order to compensate for the negative phenomena mentioned above, an increased expenditure in constructional and manufacturing terms is necessary. This increased expenditure concerns the system for moving a corresponding contact part, on the one hand, but also the contacts themselves.

It is therefore a task of the invention to propose a further developed short-circuiting device for use in low-voltage and medium voltage systems for protecting parts and personnel, which has a compact design and a simultaneously high current carrying capacity and moreover enables extraordinarily short closing times to be kept.

The solution of the task is performed in accordance with the feature combination according to claim 1, with the dependent claims comprising at least appropriate configurations and further developments.

The inventive teaching refers to the basic idea of realizing a bounce-reduced contact system which concerns a plastic deformation of a part of the mutually opposite contacts. In addition, but also alternatively, there is the possibility to obtain a current division and thus a higher current carrying capacity by realizing a several, in particular two separate contact systems in the short-circuiter.

In the bounce-reduced contact system, the movable contact part is provided with a relatively long, flat angled, conical contact area and quasi as a hollow cylindrical contact preferably equipped with a spring drive. In the open state, the movement of the movable contact part is blocked.

When the short-circuiter is correspondingly activated, the prestress force, in particular the spring force is released and assisted by at least one further force component which accelerates the closing movement.

The movable contact part is situated in a fixed contact electrode having the same potential and, in the tripped state, has a very long, preferably coaxial sliding contact without additional spring contacts or the like. The sliding contact features a gap dimension of $\leq 1/10$ mm.

With regard to the fixed contact electrode, the kinetic energy of the movable contact part is transformed into a plastic deformation, whereby contact-bouncing and a detrimental electric arc phase can be avoided.

According to the inventive idea of supplementing or else an alternative, a first contact system initiates a first metallic short-circuit in a very short time. Prior to the metallic short-circuit, however, the first contact system trips an irreversible movement of a second contact system.

The first contact system conducts the current at 100% until the second contact system closes. The closing of the second contact system is performed in an electric arc-free manner, since an electric arc will not develop during closing, and an electric arc is also excluded due to the parallel metallic short-circuit when bouncing takes place during closing.

Hereby, the contacts of the second contact system remain undamaged and the current carrying capacity is not impaired.

The first contact system may be optimized due to the reduced requirements in terms of current carrying capacity or with respect to the speed of the tripping function or contact closing.

The second, additional contact system is provided with a longer stroke path and a higher driving force and a larger contact surface and thus a higher current carrying capacity.

The first contact system preferably is provided with a sacrificial element known per se which keeps the contacts at a distance, i.e. spaced apart, by pressure or tension application.

The movable contact of the second contact system is held preferably on the moved contact by means of a ball guide, for example.

The holding function is adjustable via an inclined plane so that the spring system of the second movable contact exerts only a slight additional force effect of, for example, <10% upon the sacrificial element.

In the relevant embodiment of the invention, the movable contact part is formed as a hollow cylinder closed on one side. In the hollow cylinder, a spring is situated for generating prestress. This spring may be inserted into the hollow cylinder space in a very simple way so that an additional constructional space for the spring is not necessary.

The hollow cylinder is guided in a complementary cutout in the first contact electrode while forming a sliding contact. The hollow cylinder is thus movable in this cutout in the manner of a plunger.

In the region of the base of the closed hollow cylinder, the cylinder wall of said hollow cylinder is configured to turn into an external cone on its outer circumferential side.

Furthermore, starting from the base of the hollow cylinder, a first pin-like extension to which a second pin-like projection is opposite which is insulated from the contact electrodes, extends in the interior of the hollow cylinder.

Between the first and the second pin-like projection, the already mentioned sacrificial element is situated.

The sacrificial element preferably is realized as a bolt or screw having corresponding threads. The corresponding ends of the bolt or screw are fixed to the first and second pin-like projection via the threads or the screw head.

Moreover, a cutout which is matched to the external cone of the movable contact part and has an internal cone is provided in the second contact electrode.

The external cone and internal cone form a bounce-free short-circuit contact region with a force-fitting and interlocking connection on account of the plastic deformation which occurs.

In an implementation, exhaust openings are provided in the area of the cutout having the internal cone. These exhaust openings are situated in the second contact electrode in order to prevent pressure from building up due to a movement of the movable contact part.

These exhaust openings may be closed by a plug displacing under exposure to pressure. Similarly, a valve-like closure may be provided so that the ingress of humidity, dirt or other foreign bodies can be avoided, but the mentioned undesired pressure build-up be excluded, on the other hand.

The respective cone angle for forming the bounce-free, plastically deformable contact is in the range of ≤3°.

The contact electrodes and thus the basic construction of the short-circuiting device preferably is configured to be rotationally symmetrical. The contact electrodes are in this case kept spaced via an insulating centering ring. The entire arrangement is surrounded by an enclosing sheath.

As already mentioned, the movable contact part can move in the cutout of the first contact electrode in the manner of a plunger, wherein the energy released upon destruction of the sacrificial element and/or the energy of a forming electric arc act(s) upon the base of the movable contact in a movement accelerating manner and leads to the closing time being shortened.

In an embodiment of the invention, the second pin-like projection is surrounded by an insulating tube of a gas-emitting material.

The insulating tube may be provided with a protecting metallic sheath surrounding the insulating tube at least in part.

In a further development of the invention, a current bottleneck is formed in the current path to the sacrificial element.

According to the second basic idea of the invention, two movable contact parts are provided in a coaxial, concentric arrangement for increasing the current carrying capacity, wherein in this case the sacrificial element may also be alternatively prestressed and loaded by tensile strain instead of compressive stress.

The invention will be explained below in more detail based on FIGURES and exemplary embodiments.

Figure 2:
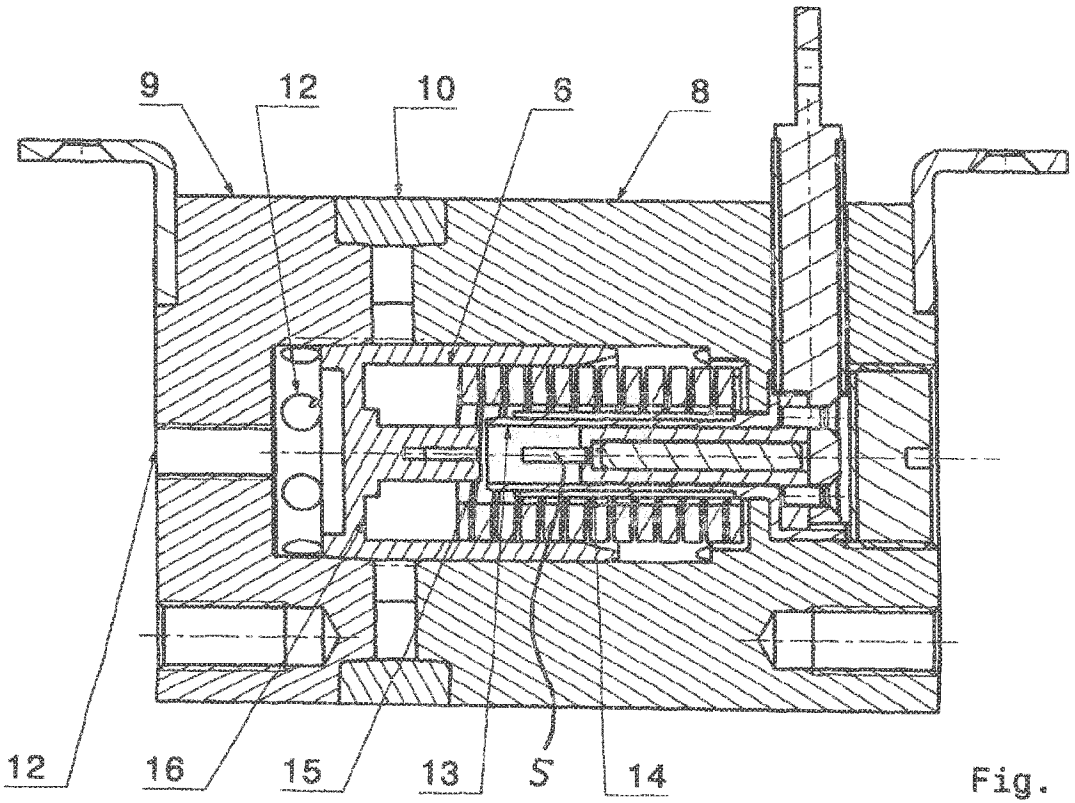
Figure 3:
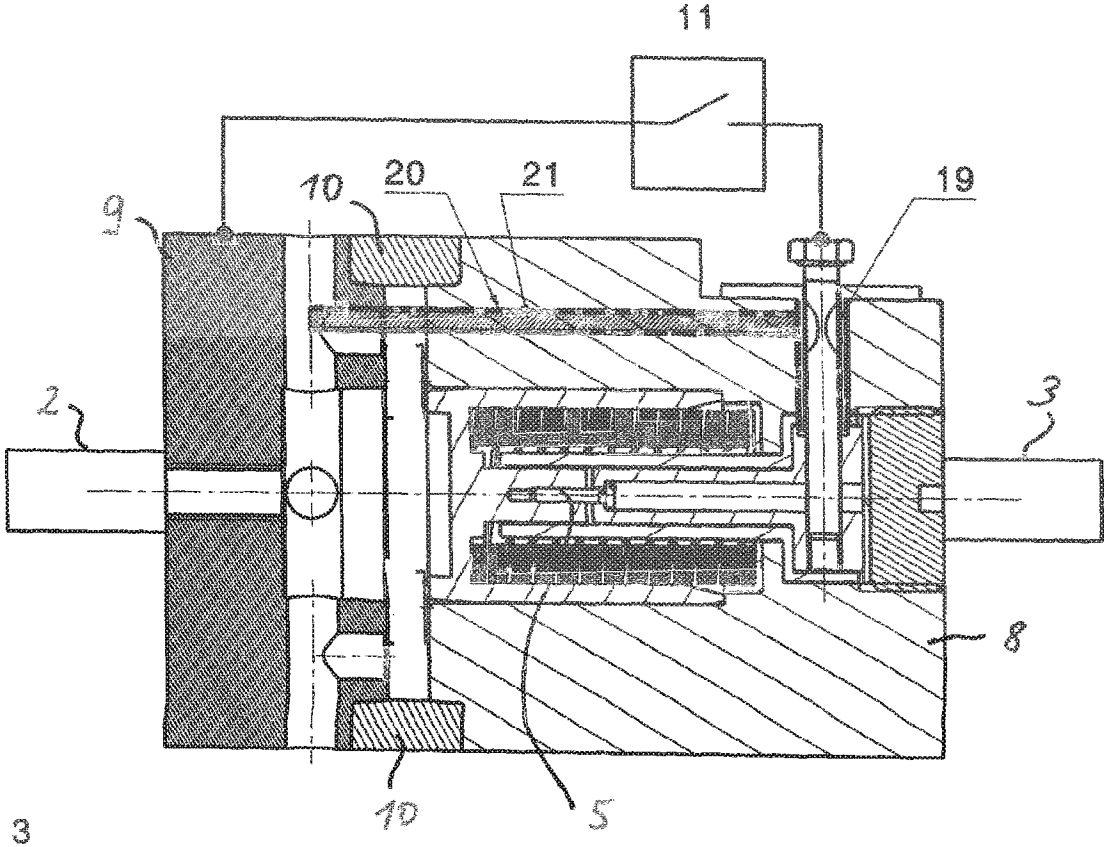
Figure 4:
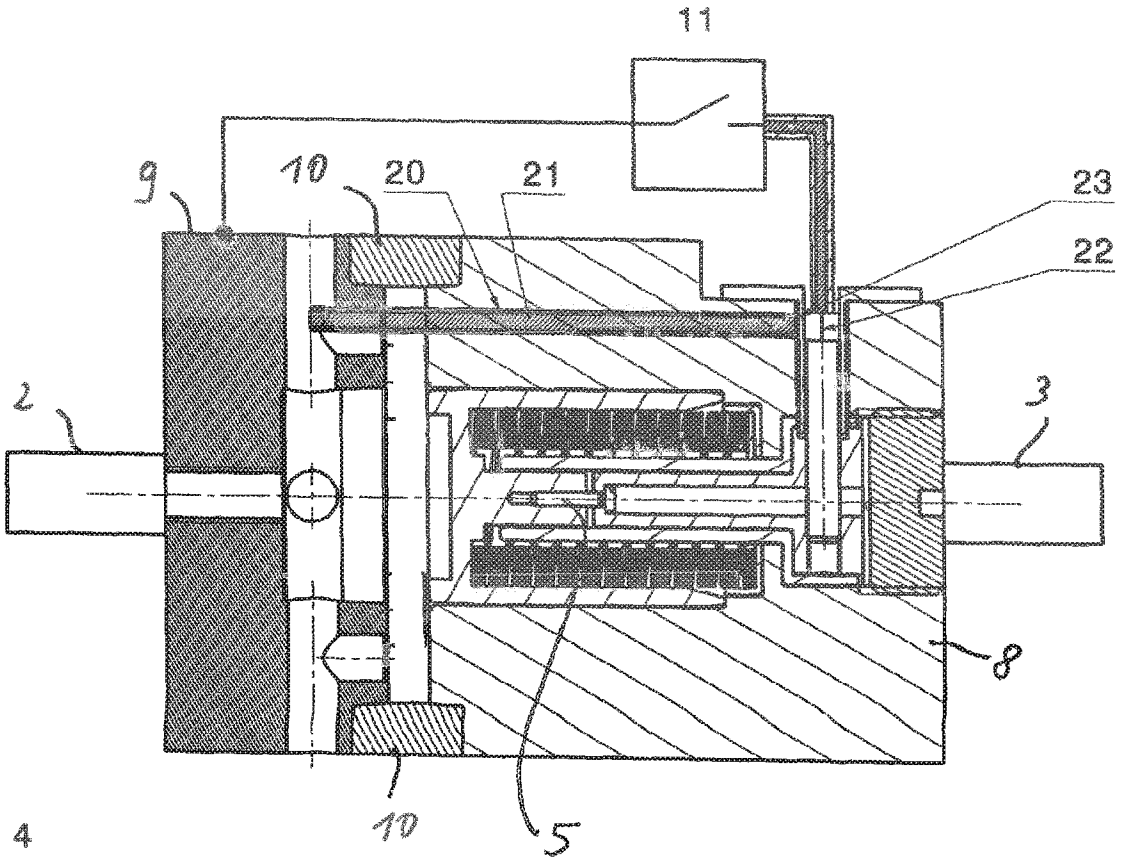
Figure 5:
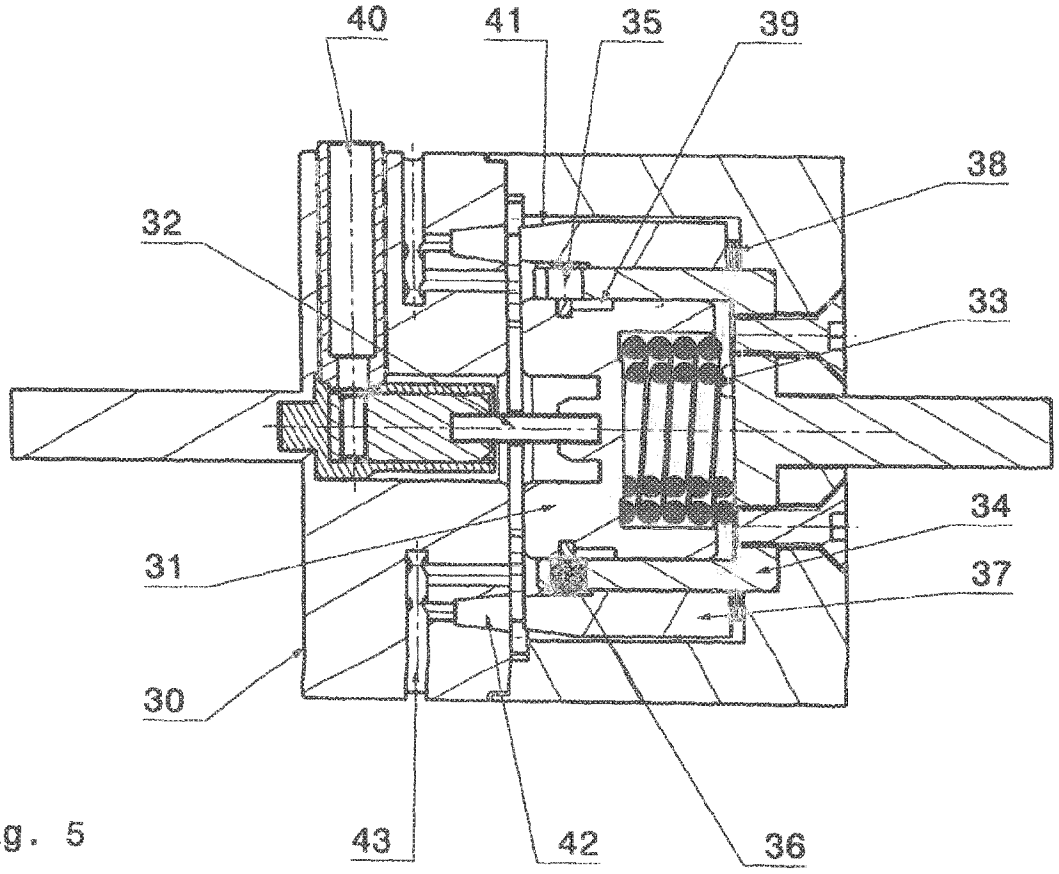
Figure 6:
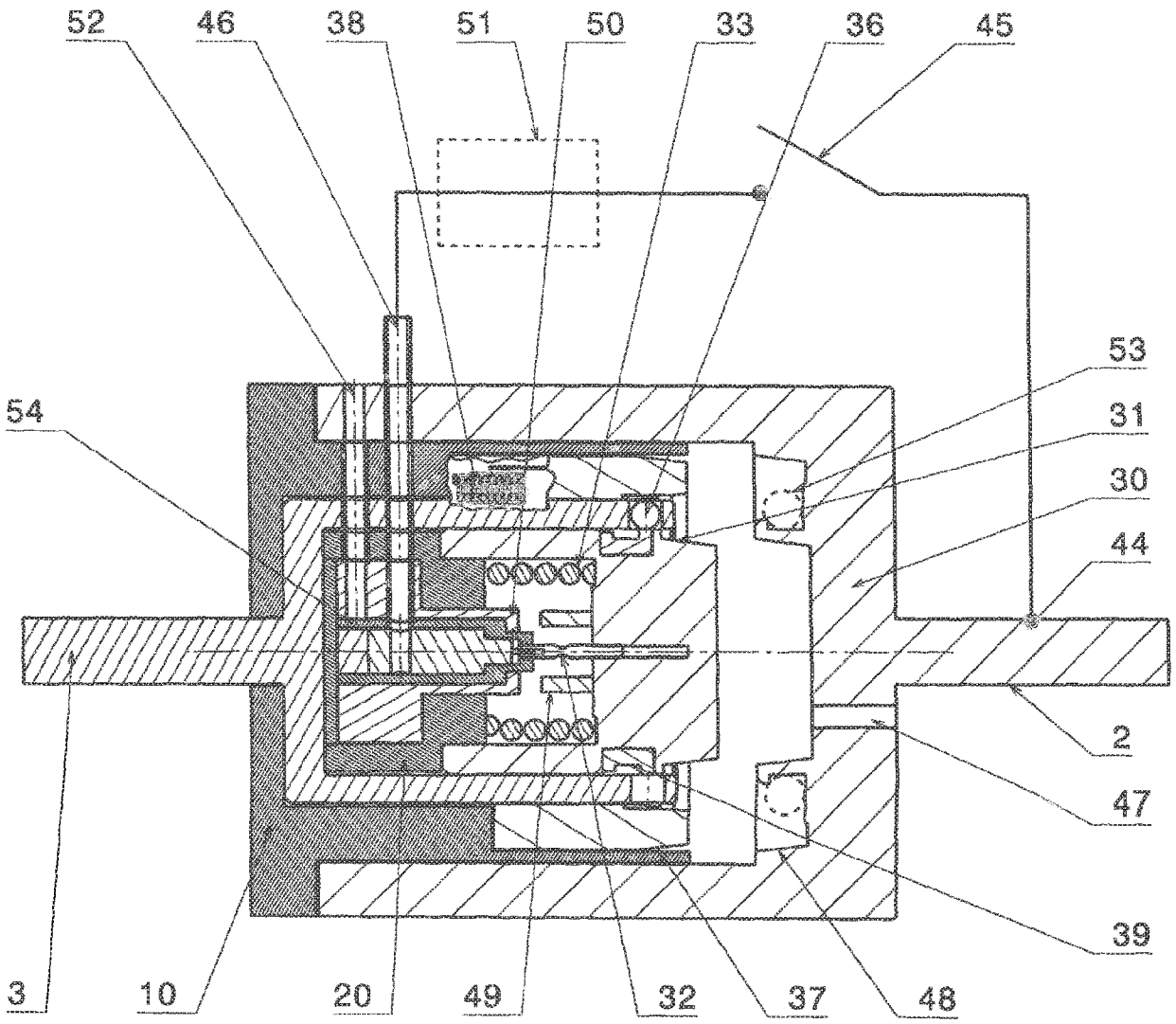

Shown are in:

FIG. 1 a representation of a longitudinal cut through a short-circuiting device according to a first embodiment in an open state;

FIG. 2 a representation of a longitudinal cut of the short-circuiting device according to the first embodiment in a closed state;

FIG. 3 a representation of a longitudinal cut of the short-circuiting device having a current bottleneck in the current path to the sacrificial element in a first variant;

FIG. 4 a representation of the short-circuiting device in a longitudinal cut having a current bottleneck in the current path to the sacrificial element in a second embodiment;

FIG. 5 a first variant of the configuration of the short-circuiting device having two movable contacts in a coaxial, concentric arrangement, wherein the sacrificial element is under compressive load, and FIG. 6 a representation similar to that according to FIG. 5 but with a tensile load of the sacrificial element there.

Pursuant to the representation according to FIG. 1, a substantially cylindrical, rotationally symmetrical short-circuiting device 1 is taken as a basis.

On its front sides, the short-circuiting device 1 features connection facilities 2; 3 for making contact to busbars or similar parts.

Apart from these connections 2; 3 having a high current carrying capacity, the short-circuiting device features at least one further connection 4 which is inserted in an insulated manner and via which the activation of the short-circuiting device 1 may be performed.

The short-circuiting device 1 has a sacrificial element which is realized as a screw or bolt 5 in the illustrated example.

The sacrificial element, i.e. the screw or bolt 5, mechanically fixes a movable contact part 6 which is mechanically prestressed via a spring 7.

The sacrificial element 5 is in electrical connection with the external connection 4 and, via the movable contact part 6, is in electrical connection with the contact electrode 8 and the external connection 3.

The second contact electrode 9 is in connection with the connection 2 and electrically separated from the first contact electrode 8 via an insulated centering part 10.

The insulated centering part 10 guides the contact electrodes 8; 9, the joint of the prementioned parts preferably being realized by a press-fit, in particular a tapered interference fit.

The movable contact part 6 is centered relative to the contact electrode 9 via the guide in the contact electrode 8.

In addition, the arrangement of the parts 8; 9 and 10 is connected and fixed by an insulating force-fitting connection after the joining, for example, by a screw connection or by an interlocking connection, e.g. by potting, which is not illustrated in the FIGURES.

According to the shown realization variant, the tripping of the short-circuiting device 1 is made by a current flow via the sacrificial element 5 after a switching element 11 establishes a connection to connection 2.

Due to the then resulting current flow via the sacrificial element 5, the sacrificial element 5 is heated and the mechanical fixing of the movable contact part 6 canceled.

Under the influence of the force of spring 7, the movable contact part 6 is moved up to the contact electrode 9, whereby the main current path between the parts 8 and 9 is closed by means of the movable contact part 6.

Current forces also act in addition to the force of the spring, which current forces assist the closing movement. This is achieved by the central conduction of the current via the sacrificial element 5 and via the substantially forced radial current conduction via the base of the movable contact part 6. This results in a current loop, the resulting force effect of which assists the spring force until the contacts between the movable contact parts 6 and the contact electrode 9 close.

For tripping the closing operation, the sacrificial element 5 is not required to melt completely. Rather, it is important for the material of the sacrificial element 5 to become softened. This softening may also occur below the melting temperature.

The representation according to FIG. 2 in turn shows a longitudinal cut through an inventive short-circuiting device having the components and assemblies already explained on the basis of FIG. 1.

In the second contact electrode 9, a cutout matched to the external cone 61 of the movable contact part 6 is provided in the internal cone 91 (see FIG. 1), wherein the external cone and internal cone form a bounce-free short-circuit contact region with a force-fitting and interlocking connection on account of the plastic deformation which occurs. This state is shown in FIG. 2.

Due to the plastic deformation, bouncing back against the direction of movement of the movable part 6 is effectively prevented. An undesired development of an electric arc in this area is avoided.

Due to the substantially lateral short-circuit contact regions, a current path is formed having a negligible force effect against the direction of movement of the movable part 6 and thus against the residual spring force. This allows the residual spring force to be reduced as compared to planar contacts, for example.

Thus, a simpler dimensioning of the spring and the movable contact part 6 becomes possible.

The arrangement of the spring 7 in the cavity of the substantially cylindrical movable contact part 6 does not result in an additional space requirement for the spring space needed. The short-circuiting device can thus be of a compact design.

Due to the external guiding of the spring 7 in the spring space of the movable contact part 6, the arrangement explained above enables the cavity of the spring to be used for the second pin-like projection 100 which is opposite the first pin-like projection 62 (see FIG. 1).

Due to the hollow cylindrical shape and the associated large cross-sectional surface, the wall thickness of the movable contact part 6 may be adapted to the mechanical requirements, for instance, the force effect of currents after closing. The wall thickness of the hollow cylinder and the base of the movable contact part 6 may be in the range of 1 mm to 3 mm, for example, depending on the material and current load.

The measures above do not only result in a very simple and compact design. Rather, the mentioned advantageous current conduction for assisting the force of the spring 7 is at the same time achieved.

The described embodiment also allows a very large sliding contact area of the movable contact part 6 to be achieved with respect to the contact electrode 8 at a low mass of the movable contact part 6. This enables a sufficient contact surface for high current loads at minimum weight and thus a high speed in the movement of the contact part 6 and comparatively low spring forces.

According to the representations of FIGS. 1 and 2, exhaust openings 12 or 92 may be provided in the area of the contact electrode 9, which prevent pressure from being built up as a result of the compression of the gas during a rapid movement of the contact part 6.

These exhaust openings 12; 92 may be closed by a membrane, a valve or easily opening closing elements such as a plug. Pressure compensation, however, may also be performed within a substantially closed short-circuiter with suitable ducts in the contact electrode 8 and/or in the movable contact part 6.

After a closing movement of the short-circuiting device, the contact area between the movable contact part 6 and the contact electrode 8 is several times, i.e. at least three times larger than that between the contact electrode 9 and the movable contact part 6, since a plastic deformation preferably will not take place in this area.

The electrical contact is realized via a sliding contact of a substantially coaxial configuration having a gap dimension of preferably <0.1 mm, at maximum 0.2 mm.

For improving the sliding properties and the electrical characteristics, the related surfaces may feature a suitable coating.

With a corresponding dimensional design, the sliding contact is capable of carrying high currents in a short time without the formation of an electric arc without additional contact lamellas and without plastic deformation and allows to be adapted to high continuous currents.

After closing of the short-circuiting device, the main current path is thus realized by a force-fitting press connection with plastic deformation of the conical short-circuit contact region between the contact part 6 and the contact electrode 9, as well as the sliding contact between the contact part 6 and the contact electrode 8 at only a low force. This results in a very simple realization of a high-performance current connection which can be realized without complex elastic contact elements such as contact lamellas, for example. Likewise, damping elements or specifically mounted and guided contact elements for absorbing the kinetic energy and avoiding the bouncing behavior of the movable contact part are not necessary.

Avoiding permanent lamella contacts allows not only the costs to be reduced. Also, the forces required for rapid movements are reduced, and the convertible energy for plastic deformation is increased.

In an exemplary configuration of the movable contact part 6 with a weight of substantially 100 g and an outer diameter of about 30 mm, a spring force of about 800 N and a comparatively short path of displacement of the contact part 6 results in a kinetic energy of several Joules, which is converted to a great extent into plastic deformations in the contact area.

With a cone having a cone angle of <3° and, for example, a cone length of 6 mm together with the contact electrode 8, this energy will already lead to an extension of the theoretical path of displacement when a simple form fit of some 100 μm is adopted.

In the preferred embodiment of the short-circuiting device for short-circuit currents of several 10 to 100 kA, the energy available for the plastic deformation and exclusively effected by the spring force amounts to at least 10 Joules. As a result of the spring force being assisted by additional forces pursuant to the embodiment of the teaching according to the invention, extensions of the path of displacement of >0.5 mm to 2 mm are achieved when the current is interrupted after melting of the sacrificial element.

Without interruption of the current, the kinetic energy increases to several 10 Joules, whereby the path of displacement is extended by several millimeters as compared to that in a mere form fit. In such a configuration, the path of displacement may be limited by appropriate means, since for a sufficient current carrying capacity, only a slight penetration depth of the contact part 6 with regard to the contact electrode 8 is enough according to the illustrated representation.

The length of the sliding contact and the gap dimension between the movable contact part 6 and the contact electrode 8 are configured such that further requirements relevant to the functional safety can be influenced positively.

When an electric arc or hot gases develop in the area of the sacrificial element 5, hot gas, plasma and/or conductive particles, soot or the like might get into the area of the spark gap between the contact part 6 and the contact electrodes 8 and 9 via the gap of the sliding contact before the contact part 6 and the contact electrode 8 are metallically short-circuited.

These gases and/or residues might damage the contact area in advance or else result in a pre-discharge in the area of the spark gap which, apart from a contact damage, also leads to a counterforce with regard to the driving force of the spring. These hazards can be significantly reduced by matching the gap dimensions and a corresponding length of the sliding contact.

In case of a high hazard which can be assessed with respect to the impurities and/or advanced ignitions, the above-mentioned matching should possibly be supplemented by further measures such as, for example, sealing off the pressure space around the sacrificial element at least temporally until the metallic contact is reached, by correspondingly redirecting gas between the zone of development and the gap area and/or by an air exhaust in the contact electrode 9, which is possibly released temporally only after the contact part 6 starts to move and discharges the main gas quantity without passing the gap area.

Because gas is prevented from flowing through the gap of the sliding contact, the proposed embodiment of sliding contact and gap dimension is utilized to profit, in the fault event of an electric arc developing in the sliding area of the contact part 6, from the development of molten metal for creating a metallically highly conductive connection.

Such a fault event may be caused, for example, by high dynamic forces which act upon the contact part 6 due to an unfavorable installation. The molten metal occurring in this case by the electric arc occurring temporally in the contact area, is urged into and held in the narrow gap between the contact part 6 and the contact electrode 9. This leads to a further reduction of the gap dimension, the decrease of the play between the contact part 6 and the contact electrode 9 even under high force effect, and to a metallic short-circuit due to the rapid cooling of the molten metal in the well cooled area.

A further mechanical acceleration of the contact part 6 may be achieved through supporting measures.

In the embodiment with a sacrificial element 5, the heat generation but also the electric arc development upon overloading of this part may be utilized to provide an additional force with regard to the force of spring 7.

According to FIG. 2, the space around the sacrificial element 5 is delimited, for example, by tubular parts 13 and 14 at least prior to the movement of part 6. When an electric arc develops, high pressure is abruptly built up within this delimited space due to the temperature, which pressure acts, via the surfaces 15 and 16, upon the movement of the contact part 6 as an assisting force.

The closing time of the short-circuiter may hereby be shortened.

The thermal energy of the sacrificial element 5, when it is under flow-induced load, and/or that of the electric arc can be utilized to generate additional gases, for example, via the hard gas effect known per se, or else via the triggering of gas generators which increase the pressure and thus the force acting upon the movable switching part 6.

As a support, further exothermal reactions may also be utilized which contribute to an effective pressure increase even without a permanent heat or electric arc effect by the sacrificial element.

According to FIG. 2, the second pin-like projection 100 may be surrounded by an insulating tube 13 of a gas-emitting material. The tube of gas-emitting material, e.g. POM, may be reinforced mechanically by a further tube or a sheath 14. Such a simple option of generating gas allows the time until the short-circuiting device closes to be reduced by about 30%.

Basically, there is the option of dispensing with the spring force storage or spring drive and to use conventional pyrotechnical drives in this respect.

The switching element 11 may be configured as a fast-acting mechanical switch, as a spark gap but also as a semiconductor switch.

The switching element 11, after having been actuated, must be capable of conducting the current until the closing of the main path via the contacts of the components 6, 9 and 8.

Apart from a short-circuit-proof configuration of the actuation path with the switching element 11, a current interruption of the auxiliary path by using a fuse 17 (FIG. 1) is possible.

For a safe actuation of the short-circuiter, it is important to set the melting integral of the fuse 17 higher than the melting integral of the sacrificial element 5.

Fuses of such a type are already suitable which only lead to an impedance increase.

If a real current path power cut-off is needed also in particular against high voltages, the level of the cut-off voltage has to be taken into account in selecting NS fuses, for example.

The switching voltage inter alia burdens the spark gap between the assemblies 6, 8 and 9 also during the closing process. In order to reliably avoid pre-discharges in this area, the switching voltage of the fuse 17 may be limited appropriately by an overvoltage protection element as required. Here, a parallel connection of a varistor is suitable, for example.

The interruption of the current may also result in a currentless break. If such a currentless break is undesired, there is the option of realizing an auxiliary short-circuit. The auxiliary short-circuit may be implemented in the simplest form, for example in the case of semiconductor switches, as a substantially pressure-resistant enclosure 18 having a spark gap function. When the semiconductor as the switching element 11 is overloaded, the spark gap will be ignited passively or actively and carries the current until the contacts close. An auxiliary short-circuiter, however, may also be activated immediately during or after triggering the movement of the movable contact part 6 and discharge the control path including the switching element 11. Such a facility may be associated immediately with the function of an additional fuse element having a limited switching capacity, but also directly with a fuse-like function of the sacrificial element 5.

Regarding this, FIG. 3 shows an exemplary embodiment.

A further bottleneck 19, which has about the same melting integral value as the sacrificial element 5, is integrated in the area of the control path.

The melting in the area of the bottleneck 19 leads to an electric arc which bridges the insulation gap or destroys an insulation. This enables a current flow from the permanent connection 3 to the permanent connection 2 already before the metallic short-circuit of the corresponding contact electrodes using the movable contact part 6.

The current flow is enabled via a feed through having an isolator 20 and a conductor 21 of sufficient cross-section. The control path including the switch 11 may thus be implemented in a space-saving and low-cost manner.

The currentless break, which might occur when the control path is cut-off, is hereby reliably prevented even at high currents.

The explained arrangement also allows a parallel connection of two short-circuiters for increasing the current carrying capacity with only one switching element 11. For this purpose, both of the short-circuiters having an opposite orientation and electric series connection of the control paths including the sacrificial element may be simultaneously operated by means of only one switching element 11.

FIG. 4 shows a similar arrangement as already explained on the basis of FIG. 3. According to FIG. 4, however, the melting integral value of the bottleneck realized e.g. as a wire 22 situated in the activation circuit of the switching element 11, is very low.

After driving the switching element 11, an electric arc will develop at the bottleneck 22 although the melting integral value of the sacrificial element 5 is not yet reached.

The electric arc, however, bridges the spark gap in the area 23 and allows a flow of current via the auxiliary conductor 21.

The exemplary embodiment shown in FIG. 4 allows a low-cost, since low-power configuration of the activation branch including the switching element 11.

After the ignition of the electric arc in the area 23, this circuit will be immediately relieved and may be additionally protected, if appropriate, by a small fuse 17.

The activation of the main short-circuiter is in this case performed in two stages, a flow of current through the short-circuiter, however, being guaranteed at all times in an interruption-free manner.

According to the second aspect of the invention, a supplemental option of increasing the current carrying capacity is the division and separation of functions of the short-circuiting device by an arrangement having at least two contact areas.

Regarding this, FIG. 5 shows an exemplary embodiment.

The contact 30 there is a common fixed contact for both of the movable contacts of the first and second stage.

The movable contact 31 of the first stage is kept at a distance from the fixed contact 30 by a sacrificial element 32 which is under compressive load by springs 33.

The sacrificial element 32 is insulated against the contact 30 and has a completed terminal contact 40 for driving.

The first movable contact 31 is guided in a stationary contact 34 and connected to it via a cylindrical sliding surface. The contact 34 has a plurality of openings 35 distributed over its circumference, in which balls 36 or rollers having a slightly larger diameter than the wall thickness of the stationary contact 34 are guided.

The second movable contact 37 is guided likewise via a sliding contact at the outer side of the stationary contact 34. The contact 37 is of a hollow cylindrical shape and provided with an edge supported on the balls or rollers 36.

The contact 37 is pre-stressed via springs 38.

The edge may turn immediately into the conical area of the second movable contact 37, resulting in a relatively steep cone for the contact area due to the desired force distribution.

The contact area thus has large, substantial lateral, i.e. radial contact surfaces.

The contact part 31 circumferentially has a groove 39 which is arranged above the balls 36 in the tensioned state.

If the sacrificial element 32 is overloaded and the movable contact 31 moves toward the fixed contact 30, the balls 36 are displaced into the groove 39 due to the force of the springs 38, and the conical area 41 of the second movable contact 37 is released and moves into the conical groove 42 of the fixed contact 30, whereby both of the stages are closed. Of course, the first movable contact 31 as well may have a conical shape at its outer circumferential side.

An advantage of the explained arrangement is the substantially simple coaxial design, the same direction of movement of the movable contacts, and the common mounting of the movable contacts 31, 37 on a common sliding contact 34. This causes a rapid current commutation and low current forces also when the second contact is closing.

In a corresponding configuration, the balls 36 act also as a blocking device against a lift-off of the first stage. This blocking function may be assisted by a partially elastic mounting of areas of the contact 30.

In order to avoid that, in case of the sacrificial element being destroyed, particles or else forces of the electric arc counteract the spring force 33 despite of exhaust openings 43 in the area of pressure development, it is also possible to subject the sacrificial element 32 to tension instead of compressive load. Such an implementation is illustrated in FIG. 6.

The sacrificial element 32 keeps the movable contact piece 31 at a distance from the fixed electrode or the fixed contact 30 against the spring tension 33. The sacrificial element 32 is characterized by a relatively small $I^2t$ value ($\leq 40\ kA^2s$), high tensile strength and high yield strength, i.e. low elongation.

When current flows at the terminal 44 via the switch 45 and the insulated feed through to the sacrificial element 32, the sacrificial element 32 is molten or destructured. Under the force of spring 33, the movable contact 31 is pressed upon the fixed contact 30. The contact surfaces, which in this case are likewise conical, will not be damaged in advance by the electric arc developing when the sacrificial element 32 melts. In the base area of the cone which is not used for enlarging the contact surface, since there is an edge contact, an air exhaust 47 may be provided.

Such air exhausts may also be present in the area of the second contact surfaces.

The second movable contact piece 37 is in turn fixed via balls 36 to the movable electrode or the movable contact 31 via an edge of the cone.

Upon a movement of the contact 31, the balls can be displaced into the groove 39 of the part 31, whereby the springs 38 displace the movable part 37 toward the opposite contact 48.

In the variant according to FIG. 6, the force acting upon the moved part 31 can be increased with respect to the mere spring force 33. The effect of pressure of the electric arc developing through the melting of the sacrificial element 32 may be enhanced by hard gas, e.g. the part 49. If only a slow air exhaust from this area is realized, the force effect can also be maintained after closing of the contacts, whereby the contact force is increased over this time range.

In the area of the electric arc development of the sacrificial element 32, a further auxiliary electrode may be inserted in addition which guides the potential of contact 30.

Immediately after the ignition, the electric arc can shift to such an auxiliary contact 50. Due to this measure, the switch 45 is discharged from a current flow already before the closing of the contacts 30 and 31. This discharge of the switch 45, however, may also be realized by a current interruption by means of the switch 45 or a fuse 51 after the $I^2t$ value of the sacrificial element 32 has been reached. The approach without any auxiliary contact 50 is in particular sufficient when a short currentless break is acceptable in the application due to a short closing time of the contacts.

The short-circuiters according to the examples presented above may be combined, as required, with mechanical, electrical, optical but also other displays or telecommunications means which are geared or tuned to driving, current loading of the activation path, overloading the sacrificial element, starting the movement of the moved contact or reaching a determined position of the moved contact.

Such a sensor technology may at the same time detect and display effects of aging.

In the area of the insulated section 10 after closing, the minimum cross-section of the movable contact part 6 according to the illustrations of FIGS. 1 to 4 is in the case of copper or aluminum about 150 $mm^2$, preferably 240 $mm^2$. The penetration depth of the contact part 6 into the cone of part 2 is at least 3 mm, and preferably is designed to be >6 mm.

The weight of the contact part in one embodiment may be a maximum of 150 g, preferably may amount to 100 g.

The initial spring force of spring 7 is >800 N, and preferably is about 1100 N. The air gap between the contact electrodes 8; 9 is at least 3 mm, preferably >5 mm.

As the contact material, metals or graphite based materials are preferably applicable.

The material of the sacrificial element 5 or 32 has high mechanical tensile strength at a low specific melting integral. In the simplest case, the sacrificial element is configured as a screw of stainless steel or a bolt of stainless steel. In particular for the tensile load, materials are advantageous, in which, upon a current flow due to heating, strong softening occurs already before reaching the melting temperature.

This allows the reaction time and the closing time after driving to be significantly shortened in particular upon low current rates of rise. Such a positive effect is known from some steels. Basically, however, materials having an active change of geometry may be used as well.

The cone in the area of the short-circuit contact has an angle of <10°, preferred of <3°, whereby the deformation in the closing area and the reduction of the kinetic energy prevents the disadvantageous bouncing tendency sufficiently even in spring drives having high elasticity and low spring forces.

The impedance of the driving path of the short-circuiting device including the switching element 11 is in the range of <10 mOhm, in particular <5 mOhm.

The peak current carrying capacity of the individual short-circuiters is clearly above 200 kA, and the short-term current carrying capacity is >100 $kA_{eff}$. The continuous current carrying capacity is above 1000 A.

In a preferred embodiment, the closing time of the main path clearly falls below 2 ms exclusively due to the spring force at an isolating gap section of 6 mm. Due to the assistance of additional forces according to the teaching of the invention, the real closing times decrease to about 1 ms.

Apart from increasing the spring force and the additional forces by reducing the mass of the movable contact part 6, suitably reducing the effective spring mass, the centering and optimizing of the force effect, and neatly guiding the contact part 6 in the idle and moved states allows the closing time to be further decreased. A reduction of the closing time is also possible by enlarging the effective pressure surfaces and reducing the effective pressure volume, i.e. the space around the sacrificial element. In the two-stage embodiment of the short-circuiting device, a first one of the contacts may be optimized for speed and a relatively low current carrying capacity and low bouncing tendency. The second stage, i.e. the second pair of contacts, closes in an arc-free manner and may be adjusted to a high current carrying capacity, with the closing time itself being subordinate. Designing the contacts and stroke paths is possible independent of one another.

At least one of the two-stage embodiments is lockable, wherein the locking may be assisted by an elastic mounting of a partial contact.

With reference to FIG. 6, the elastic mounting may be realized by way of example using a spring or a resilient element 53 in the cone area 48. In the sectional representation according to FIG. 6, a solution is taken as a basis, which comprises the idea of the deformation of the first stage as an internal stage with an inverted sacrificial element combined with the two-stage approach in terms of an external stage. The specific form of the sacrificial element together with the additional auxiliary contact 50 and its isolated inlet 52/54, and the radially circumferential spring together with the hard gas-emitting element 49, which may still be in powder form, represent optional means.

The invention claimed is:

1. A short-circuiting device for use in low-voltage and medium-voltage systems for protecting parts and personnel, comprising a switching element (11) which can be operated by the tripping signal of a fault detection device, two mutually opposite contact electrodes (8; 9) having power supply means (2; 3), wherein contact can be made with said contact electrodes at an electrical circuit having connections at different potentials, furthermore, in at least one of the contact electrodes (8), a moving contact part (6) which is under mechanical prestress and executes a movement to the further contact electrode (9) in a manner assisted by spring force in the event of a short-circuit, a sacrificial element (5; 32) as spacer between the contact electrodes (8; 9) and also having an electrical connection between the sacrificial element (5; 32) and the switching element (11) on the one hand and one of the contact electrodes on the other hand, in order to cause current flow-induced thermal deformation or destruction of the sacrificial element (5; 32) in a targeted manner, characterized in that the movable contact part (6) is in the form of a hollow cylinder which is closed on one side, and a spring (7) for generating prestress is inserted in the hollow cylinder, the hollow cylinder is guided in a movable manner in a complementary cutout in the first contact electrode (8) so as to form a sliding contact, and in the region of the base (16) of the closed hollow cylinder, the cylinder wall of said hollow cylinder turns into a cone (61) on its outer circumferential side, furthermore, starting from the base, a first pin-like extension (62) which is situated opposite a second pin-like projection (100) which is insulated from the contact electrodes (8; 9) is arranged in the interior of the hollow cylinder, wherein the sacrificial element, in the form of a bolt or screw (5; 32), is arranged between the first and the second pin-like projection (62; 100), and a cutout which is matched to the external cone (61) of the movable contact (6) and has an internal cone (91) is provided in the second contact electrode (9), wherein the external cone and internal cone form a bounce-free short-circuit contact region with a force-fitting and interlocking connection on account of the plastic deformation which occurs.

2. The short-circuiting device according to claim 1, characterized in that exhaust openings (12; 92) connected to the area of the cutout with the internal cone are provided in the second contact electrode (9) so as to prevent pressure from building up due to the movement of the contact part (6).

3. The short-circuiting device according to claim 2, characterized in that the exhaust openings (12; 92) are closed by a plug or a valve displacing under exposure to pressure.

4. The short-circuiting device according to claim 1, characterized in that the gap dimension of the sliding contact is <0,2 mm.

5. The short-circuiting device according to claim 1, characterized in that the respective cone angle is in the range of ≤3°.

6. The short-circuiting device according to claim 1, characterized in that the contact electrodes (8; 9) are configured to be rotationally symmetrical and are kept spaced via an insulating centering ring (10).

7. The short-circuiting device according to claim 1, characterized in that the movable contact part (6) moves in the cutout of the first contact electrode (8) in the manner of a plunger, wherein the energy released upon destruction of the sacrificial element (5; 32) and/or the energy of a forming electric arc act(s) upon the base (16) of the movable contact (6) in a movement accelerating manner.

8. The short-circuiting device according to claim 1, characterized in that the second pin-like projection (100) is surrounded by an insulating tube (13) of a gas-emitting material.

9. The short-circuiting device according to claim 8, characterized in that the insulating tube (13) is provided with, in particular surrounded by a supporting metallic sheath (14).

10. The short-circuiting device according to claim 1, characterized in that a current bottleneck (19; 22) is formed in the current path to the sacrificial element (32).

11. The short-circuiting device according to claim 1, characterized in that two movable contacts (31; 37) are formed in a coaxial, concentric arrangement for increasing the current carrying capacity.

12. The short-circuiting device according to claim 11, characterized in that the sacrificial element (32) is prestressed and loaded by tension.

* * * * *